US008740655B2

(12) United States Patent
Kato et al.

(10) Patent No.: US 8,740,655 B2
(45) Date of Patent: Jun. 3, 2014

(54) LOW HEIGHT CONNECTOR AND METHOD OF PRODUCING THE SAME

(75) Inventors: Hajime Kato, Kakegawa (JP); Masayuki Kataoka, Kakegawa (JP); Hiroki Komatsu, Kakegawa (JP); Takeshi Innan, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 20 days.

(21) Appl. No.: 13/552,782

(22) Filed: Jul. 19, 2012

(65) Prior Publication Data

US 2013/0023158 A1 Jan. 24, 2013

(30) Foreign Application Priority Data

Jul. 20, 2011 (JP) ..... 2011-159124

(51) Int. Cl.
*H01R 4/18* (2006.01)

(52) U.S. Cl.
USPC ..... 439/736; 439/606

(58) Field of Classification Search
USPC ..... 439/604–606, 736
See application file for complete search history.

(56) References Cited

U.S. PATENT DOCUMENTS

| | | | | |
|---|---|---|---|---|
| 2,091,824 | A * | 8/1937 | Lewis | 174/151 |
| 2,973,501 | A * | 2/1961 | Mapelsden et al. | 439/456 |
| 3,182,282 | A * | 5/1965 | Turner | 439/423 |
| 3,328,504 | A * | 6/1967 | Hamel | 264/272.14 |
| 4,310,208 | A * | 1/1982 | Webster et al. | 439/494 |
| 5,217,388 | A * | 6/1993 | Brown | 439/455 |
| 5,941,718 | A * | 8/1999 | Didier | 439/170 |
| 6,482,036 | B1 * | 11/2002 | Broussard | 439/606 |
| 8,449,328 | B2 * | 5/2013 | Ooki | 439/606 |
| 8,480,421 | B2 * | 7/2013 | Yoshioka et al. | 439/275 |
| 2004/0092164 | A1 * | 5/2004 | Lee | 439/606 |
| 2004/0142597 | A1 * | 7/2004 | Mizutani | 439/606 |
| 2005/0020133 | A1 * | 1/2005 | Homann et al. | 439/606 |
| 2006/0068637 | A1 * | 3/2006 | Meleck et al. | 439/606 |
| 2012/0040571 | A1 * | 2/2012 | Yoshioka et al. | 439/736 |
| 2013/0023158 | A1 * | 1/2013 | Kato et al. | 439/625 |

FOREIGN PATENT DOCUMENTS

JP 2010-211935 A 9/2010

* cited by examiner

*Primary Examiner* — James Harvey
(74) *Attorney, Agent, or Firm* — Sughrue Mion, PLLC

(57) ABSTRACT

A method of producing a low height connector, includes: removing an insulating covering from a first part of an electric wire; forming the electric wire into a predetermined shape in which the first part of the electric wire is bent; joining a terminal to a second part of the electric wire; and molding the electric wire to surround at least the first part and the second part of the electric wire with a housing to obtain the low height connector.

3 Claims, 4 Drawing Sheets

LOW HEIGHT CONNECTOR AND METHOD OF PRODUCING THE SAME

BACKGROUND OF THE INVENTION

The present invention relates to a connector formed by bending a large diameter electric wire which is used as a high-voltage electric wire into an L-shape, and more particularly, relates to a low height connector of which downsizing can be achieved without using a protector.

<Downsizing of a Connector>

Concerning an existing connector, it has been conducted to downsize the connector in view of necessity of a mounting space in a vehicle. In order to downsize the connector, the following two methods have been heretofore considered.

(1) Use of a protector: This is a method of providing a protector in a passage of a wire harness thereby to forcibly regulate the passage of the wire harness.

(2) Use of an L-shaped terminal: This is a method of bending a terminal of the connector into an L-shape, and forming a housing for containing the L-shaped terminal.

<(1) Use of a Protector>

An example of the connector using the protector is disclosed in JP-A-2010-211935.

The connector disclosed in JP-A-2010-211935 is a connector with an L-shaped high voltage electric wire which is formed by bending a high-voltage electric wire into an L-shape, connecting a terminal to a tip end of the high-voltage electric wire, surrounding the tip end of the high-voltage electric wire and the terminal with a housing, and then, covering the housing with a shield shell formed of aluminum. In this connector, an L-shaped bent part of the high-voltage electric wire is covered with a protector formed of resin, and further, the protector is provided with a rib thereby to give rigidity to the protector.

There are the following problems in using the protector. Firstly, components of the protectors must be provided separately for the respective passages.

Moreover, it is not easy to forcibly bend the high-voltage electric wire, because a thick wire such as the high-voltage electric wire has high resilience. Consequently, the high-voltage electric wire is bent in a large arc requiring a large space, and cannot make a low height connector.

Further, in order to forcibly regulate the passage using the protector, a thick rib for enabling the high-voltage electric wire to be bent resisting repulsion must be provided on the protector.

<(2) Use of an L-shaped Terminal>

FIGS. 3A to 3C are views for explaining a connector including terminals which have been bent into an L-shape and their housing. FIG. 3A is a perspective view of the connector having the L-shaped terminals, FIG. 3B is a front view of the connector as seen in a direction of an arrow mark 3B in FIG. 3A, and FIG. 3C is a sectional view taken along a line 3C-3C in FIG. 3B.

In FIGS. 3A to 3C, a small-sized connector 30 is provided with L-shaped terminals 30T which have been bent into an L-shape in advance. Electric wires W are connected to the L-shaped terminals 30T, a part of the L-shaped terminals 30T and the electric wires W are contained in a connector housing 30H, and then, surrounded with a protector 30P.

However, as a problem of this method, in case where a shape of the L-shaped terminals 30T is varied, the L-shaped terminals 30T become novel structures, and existing terminals cannot be used. In addition, the connector housing 30H for containing the terminals is also varied in shape and size, and becomes a novel structure, every time.

SUMMARY

This invention provides a low height connector in which existing terminals can be used, without requiring a protector, and further, without requiring a large space, and a method of producing the same.

One aspect of the invention provides a method of producing a low height connector, the method comprising: removing an insulating covering from a first part of an electric wire; forming the electric wire into a predetermined shape in which the first part of the electric wire is bent; joining a terminal to a second part of the electric wire; and molding the electric wire to surround at least the first part and the second part of the electric wire with a housing to obtain the low height connector.

One aspect of the invention provides a low height connector comprising: an electric wire in which an insulating covering is removed from a first part of the electric wire, the first part of the electric wire being bent; a terminal which is joined to a second part of the electric wire; and a housing which surrounds at least the first part and the second part of the electric wire.

DETAILED DESCRIPTION OF EMBODIMENTS

Referring to FIG. 1, a method of producing a compact connector in which existing terminals can be used without requiring a protector, and further, without requiring a large space, will be described.

<Working Steps for Producing the Mold Connector According to the Invention>

<Step 1: Preparation of a Covered Wire>

FIGS. 1A to 1E are sectional front views for explaining working steps for producing the mold connector according to the invention.

Figure 1A:
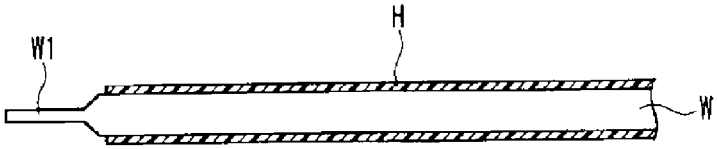
FIGS. 1A to 1E are sectional front views for explaining working steps for producing a mold connector according to the invention.

In FIG. 1A, a wire W to be used in the invention is a high-voltage electric wire formed by using a braided wire, for example. An outer periphery of the wire W is covered with an insulating covering H, and an existing terminal T is connected to a tip end W1 of the wire W.

<Step 2: Wire Covering Peeling Step>

Figure 1B:
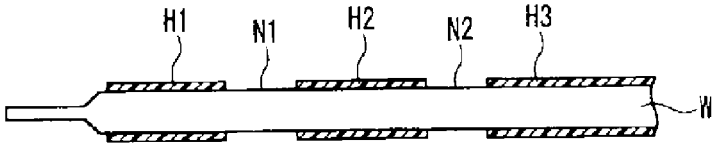

The insulating covering H of the wire W in FIG. 1A is removed only from those parts where the wire W is to be bent at a right angle in a subsequent stamping step thereby to expose the wire W. In this manner, peeled parts N1 and N2 are formed. As the results, the insulating coverings H1 and H2 remain at both sides of the peeled part N1, and the insulating coverings H2 and H3 remain at both sides of the peeled part N2, as shown in FIG. 1B.

<Step 3: Wire Forming Step>

Figure 1C:
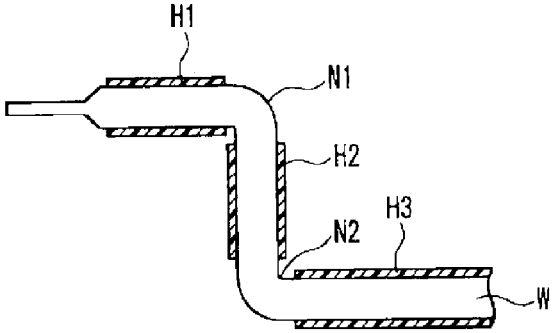

The wire W is subjected to a stamping work to be formed into an L-shape (or a Z-shape), and the wire as shown in FIG. 1C is obtained. On this occasion, the forming work can be performed with high accuracy, free from a large stress, because the peeled parts N1, N2 are not provided with the insulating covering H, and hence, the wire can be bent with a strict R (radius).

<Step 4: Terminal Connecting Step>

Figure 1D:
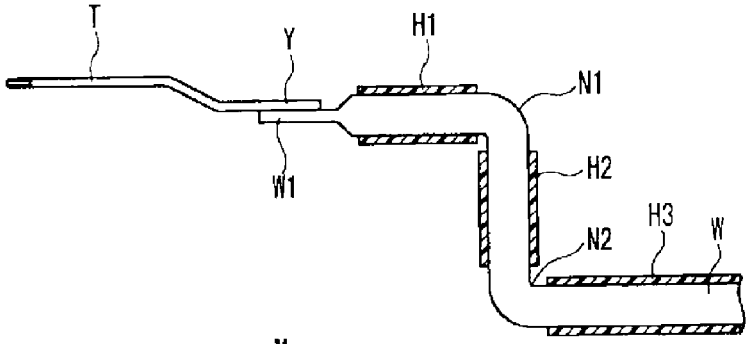

Then, an ordinary terminal T which is not bent into an L-shape is connected to the tip end W1 of the wire W, and the wire as shown in FIG. 1D is obtained.

The terminal T and the tip end W1 of the wire W, which is a twisted wire, are connected to each other by ultrasonic bonding. On this occasion, it is preferable to conduct bending work of the wire, at the same time with preforming work of the terminal T.

Moreover, a part of the insulating covering H3 to be a border with respect to a housing is surrounded with a support member S.

<Step 5: Molding Step of Housing>

Figure 1E:
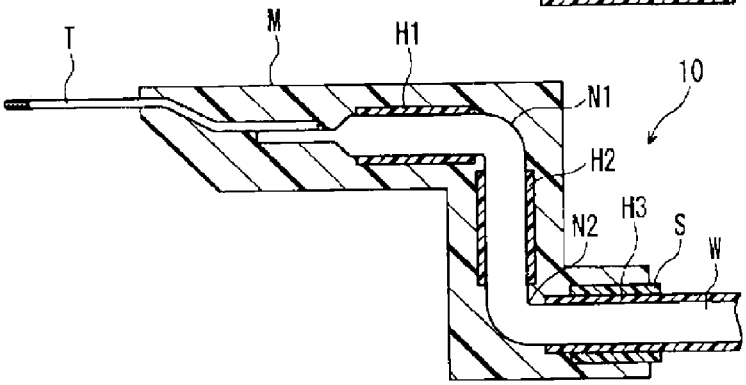

A region from a part of the terminal T which is connected to the tip end W1 of the wire W up to the support member S of the insulating covering H3 is molded thereby to forma housing M, as shown in FIG. 1E. By conducting molding work in this manner, necessity of the related-art protector is eliminated. Although the only one wire W1 is shown in FIG. 1, because FIG. 1 is a front view, a plurality of the wires W are actually arranged in parallel in a direction perpendicular to the drawing (See FIG. 2B). Therefore, the housing M is formed by molding a plurality of the wires W, a plurality of the terminals T, a plurality of the insulating coverings H3, and a piece of the support member S for supporting the insulating coverings H3, extensively with resin.

<Connector Produced According to the Production Method of the Invention>

Figure 2A:
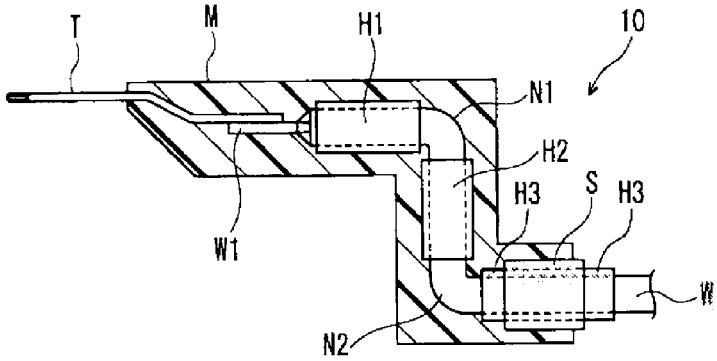
FIG. 2A is a sectional front view of the mold connector according to the invention.
Figure 2B:
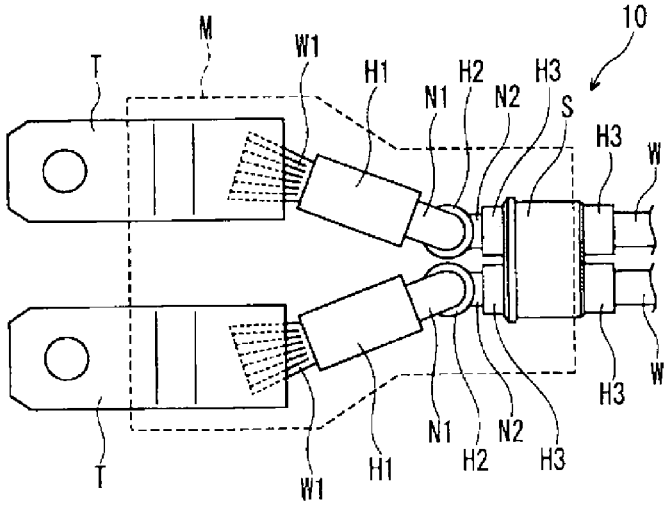
FIG. 2B is a sectional plan view of the mold connector according to the invention.
Figure 3A:
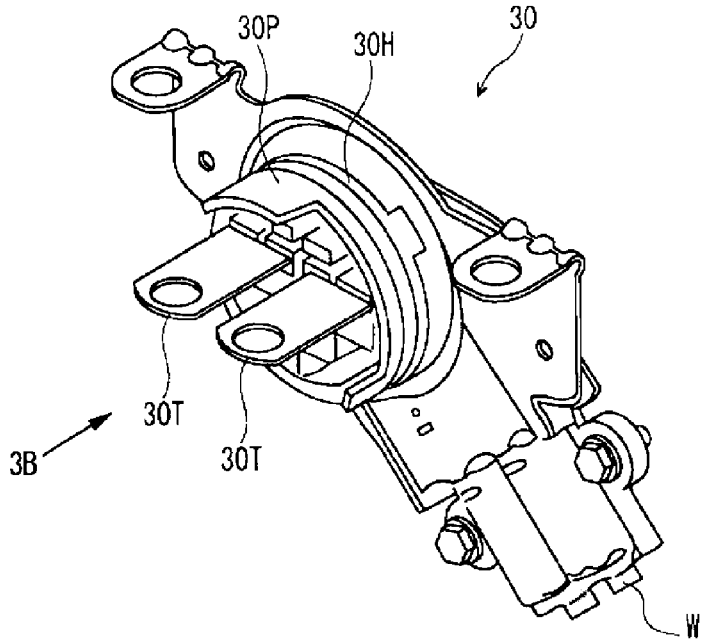
FIG. 3A RELATED ART
FIG. 3A is a perspective view of a related-art connector.
Figure 3B:
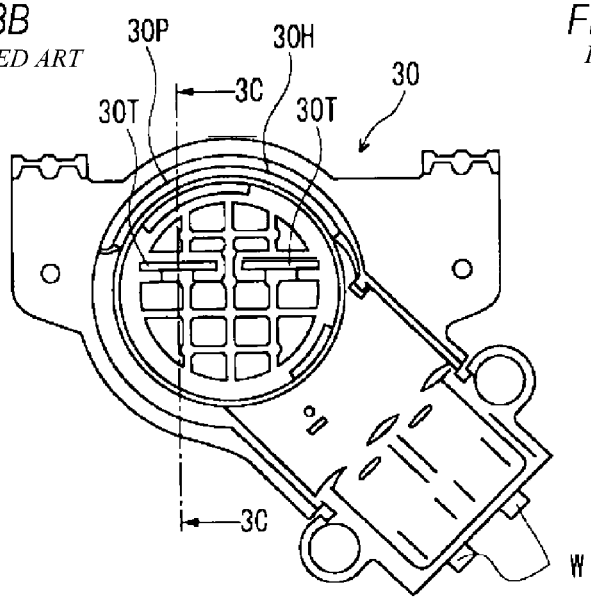
FIG. 3B RELATED ART
FIG. 3B is a front view of the related-art connector as seen in a direction of an arrow mark 3B in FIG. 3A.
Figure 3C:
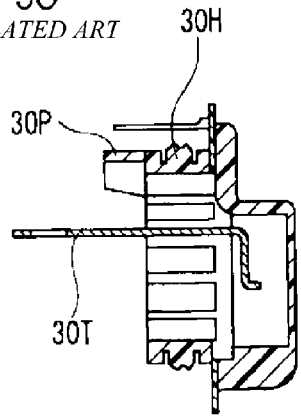
FIG. 3C RELATED ART
FIG. 3C is a sectional view of the related-art connector taken along a line 3C-3C in FIG. 3B.

FIGS. 2A and 2B illustrate the connector which is formed according to the production method in FIGS. 1A to 1E. FIG. 2A is a front view of the connector, and FIG. 2B is a sectional plan view of the same.

In FIG. 2A, the insulating covering H of the wire W is peeled off to form the peeled parts N1, N2, and the entire wire W is formed into an L-shape (or a Z-shape). The terminal T is joined to the tip end of the wire W, and the region from a part of the terminal T up to the support member S of the insulating covering H3 is molded with resin.

In FIG. 2B, the insulating coverings H of the two wires W are respectively peeled off to form the peeled parts N1, N2, as shown in FIG. 2A, and an entirety of the wires W is formed into an L-shape (or a Z-shape). The two wires W, the terminals T, the insulating coverings H, and the support member S for supporting a plurality of the insulating coverings H3 are extensively molded with resin thereby to form the housing M.

Because the housing is formed by extensively molding the wires which have been respectively bent, as described above, the related-art protector which has been required heretofore can be omitted. As the results, assembling steps and installations for the protector can be saved, and hence, cost reduction of the connector can be achieved. Besides, downsizing of the connector can be realized without using the protector.

Moreover, because the insulating covering is peeled off only from the parts where the wire is to be bent, the stress is exerted on rectilinear parts during the molding work, and deformation of the wire W is prevented.

Further, although a stamping die for the wire is required, constituent components of the connector and installations in the working line can be commonly used. Because the wire is subjected to the stamping work, after the covering of the wire has been peeled off, it is possible to bend the wire with a stricter R (radius), with higher accuracy as compared with the related-art wire using the protector.

Although a case where the two wires W are extensively molded with resin is shown in FIG. 2B, it is possible to obtain a low height connector for three phases, by extensively molding three wires W of which the insulating covering only in the parts to be bent has been peeled off.

<Related Art 1>

Figure 4:
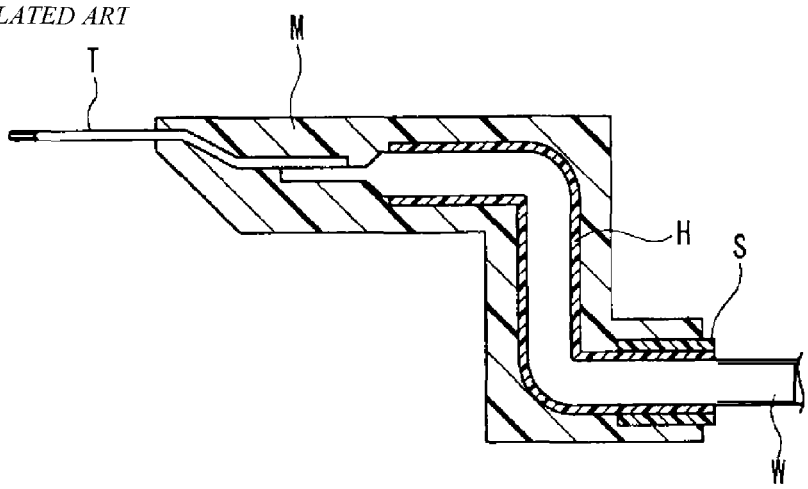
FIG. 4 RELATED ART
FIG. 4 is a sectional front view of a mold connector according to Related Art 1.

In a process to reach the invention, as Related Art 1, the inventor tried to mold a wire W having an insulating covering H, as shown in FIG. 4, with resin, after the wire has been bent into an L-shape, as it is. In FIG. 4, an entirety of the wire W having the insulating covering H is formed into an L-shape, a terminal T is joined to a tip end of the wire W, and a region from a part of the terminal T up to a support member S is extensively molded with resin thereby to form a housing M. However, in this method, an R (radius) cannot be given to the wire with high accuracy, and when the wire with the R is set in a mold, the wire is easily restored to its original shape. Therefore, there is a problem that the wire cannot be set in the mold.

<Related Art 2>

Figure 5:
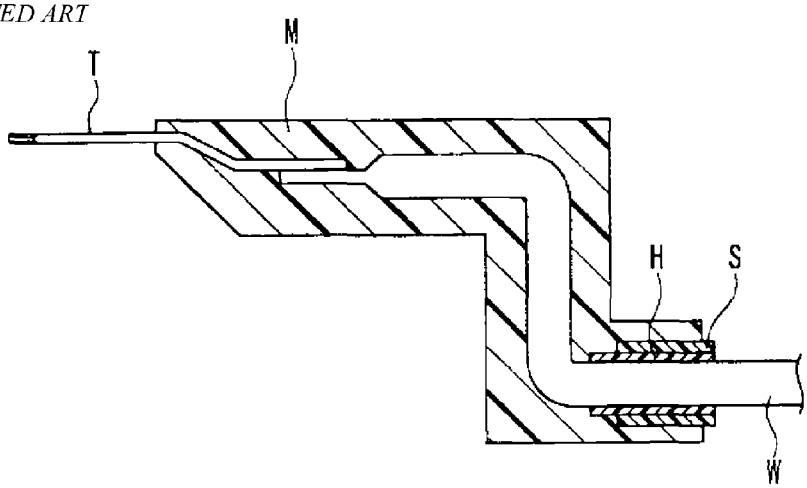
FIG. 5 RELATED ART
FIG. 5 is a sectional front view of a mold connector according to Related Art 2.

In a process to reach the invention, as Related Art 2, the inventor tried to peel off the whole insulating covering, as shown in FIG. 5, thereby to obtain a naked wire W, thereafter, to subject the naked wire W to forming work, and then, to mold it with resin. In FIG. 5, after the whole insulating covering H has been extensively peeled off and an entirety of the naked wire W is formed into an L-shape, the terminal T is joined to a tip end of the wire W, and a region from a part of the terminal T up to a support member S is extensively molded with resin thereby to form a housing M. However, in this method, there is a problem that a core wire of the naked wire is deformed, because a pressure of the resin is exerted on the naked wire during injection molding, and the wire may protrude from the housing of the molded product.

<Conclusion>

As described above, Related Art 1 and Related Art 2 have drawbacks respectively. The invention can overcome these drawbacks too, and it is possible to prevent the deformation, because the insulating covering only in the parts to be bent is peeled off, and the stress is exerted on the rectilinear parts during the molding work.

Moreover, because the housing is formed by extensively molding the wire which has been bent, as described above, the related-art protector which has been heretofore required can be omitted. As the results, the assembling steps and components for the protector can be saved, and hence, cost reduction of the connector can be achieved. Besides, downsizing of the connector can be realized without using the protector.

Moreover, the constituent components of the connector and the installations in the working line can be commonly used, although the stamping die for the wire is required. Because the wire is subjected to the stamping work, after the covering of the wire has been partially peeled off, it is possible to bend the wire with a stricter R (radius), with higher accuracy as compared with the related-art wire using the protector.

According to an aspect of the invention, it is possible to produce the low height connector in which the existing terminals can be used, without requiring a protector, and further, without requiring a large space.

What is claimed is:

1. A method of producing a low height connector, the method comprising:

selectively removing an insulating covering from first parts of an electric wire without removing the insulating covering from a second part of the electric wire disposed in between the first parts;

forming the electric wire into a predetermined shape in which each of the first parts of the electric wire is bent;

joining a terminal to the second part of the electric wire; and molding the electric wire to surround at least the first parts and the second part of the electric wire with a housing to obtain the low height connector.

2. A low height connector comprising:

an electric wire in which an insulating covering is selectively removed from first parts of the electric wire without removing the insulating covering from a second part of the electric wire disposed in between the first parts, each of the first parts of the electric wire being bent;

a terminal which is joined to the second part of the electric wire; and a housing which surrounds at least the first parts and the second part of the electric wire.

3. The method according to claim 1, wherein the forming of the electric wire into the predetermined shape comprises bending each of the first parts at approximately right angles.

* * * * *